US008528523B2

(12) United States Patent
Jung et al.

(10) Patent No.: US 8,528,523 B2
(45) Date of Patent: Sep. 10, 2013

(54) METHOD FOR DETERMINING THE RAIL PRESSURE IN A COMMON RAIL SYSTEM, AND COMMON RAIL INJECTION SYSTEM

(75) Inventors: Uwe Jung, Wörth a. d. Donau (DE); Janos Radeczky, Wenzenbach (DE); Michael Wirkowski, Regensburg (DE)

(73) Assignee: Continental Automotive GmbH, Hannover (DE)

( * ) Notice: Subject to any disclaimer, the term of this patent is extended or adjusted under 35 U.S.C. 154(b) by 384 days.

(21) Appl. No.: 12/989,580

(22) PCT Filed: Mar. 23, 2009

(86) PCT No.: PCT/EP2009/053356

§ 371 (c)(1),
(2), (4) Date: Oct. 25, 2010

(87) PCT Pub. No.: WO2009/132897

PCT Pub. Date: Nov. 5, 2009

(65) Prior Publication Data

US 2011/0036329 A1 Feb. 17, 2011

(30) Foreign Application Priority Data

Apr. 30, 2008 (DE) ..... 10 2008 021 581

(51) Int. Cl.
*F02M 69/46* (2006.01)
*F02M 69/50* (2006.01)

(52) U.S. Cl.
USPC ..... 123/456

(58) Field of Classification Search
USPC ..... 123/456, 447, 508, 198 D; 701/103, 701/104, 107; 73/114.51
See application file for complete search history.

(56) References Cited

U.S. PATENT DOCUMENTS

| | | | | |
|---|---|---|---|---|
| 6,016,791 | A * | 1/2000 | Thomas et al. | 123/497 |
| 7,810,386 | B2 | 10/2010 | Kraemer et al. | 73/114.51 |
| 2010/0179744 | A1 | 7/2010 | Baranowski et al. | 701/103 |
| 2011/0120417 | A1 * | 5/2011 | Jung et al. | 123/447 |

FOREIGN PATENT DOCUMENTS

| | | | |
|---|---|---|---|
| DE | 102007024823 | A1 | 12/2008 |
| DE | 102007030713 | A1 | 1/2009 |
| EP | 1826385 | | 8/2007 |
| JP | 07071289 | A * | 3/1995 |
| JP | 08232740 | A * | 9/1996 |
| KR | 1020010059145 | A | 7/2001 |
| WO | 0181746 | | 11/2001 |
| WO | 2008009563 | | 1/2008 |

OTHER PUBLICATIONS

International Search Report and Written Opinion for Application No. PCT/EP2009/053356 (14 pages), Jul. 22, 2009.
Ein Common-Rail-Konzept mit druckmodulierter Einspritzung, MTZ Motortechnische Zeitschrift, pp. 230-238, 2000.
German Office Action, German Patent Application No. 10 2008 021 581.3-26, 2 pages, Jan. 14, 2009.

* cited by examiner

*Primary Examiner* — Mahmoud Gimie
(74) *Attorney, Agent, or Firm* — King & Spalding L.L.P.

(57) ABSTRACT

In a method for determining the rail pressure in a common rail system of an internal combustion engine, at least one measurement variable is determined which is a measure for the angular velocity of a crankshaft movement of the internal combustion engine, and the rail pressure is determined from said measurement variable or from a variable derived from the measurement variable. Furthermore disclosed are methods that are based thereon for controlling an injection quantity and for controlling a rail pressure, and a corresponding common rail injection system.

21 Claims, 2 Drawing Sheets

METHOD FOR DETERMINING THE RAIL PRESSURE IN A COMMON RAIL SYSTEM, AND COMMON RAIL INJECTION SYSTEM

CROSS-REFERENCE TO RELATED APPLICATIONS

This application is a U.S. National Stage Application of International Application No. PCT/EP2009/053356 filed Mar. 23, 2009, which designates the United States of America, and claims priority to German Application No. 10 2008 021 581.3 filed Apr. 30, 2008, the contents of which are hereby incorporated by reference in their entirety.

TECHNICAL FIELD

The invention relates to a method for determining the rail pressure in a common rail injection system of an internal combustion engine, a method for controlling the injection quantity in a common rail injection system based on the rail pressure, a method for controlling the rail pressure in a common rail injection system, and a common rail injection system for an internal combustion engine.

BACKGROUND

In common rail injection systems a plurality of injectors (injection valves), typically all the injection valves of the corresponding internal combustion engine, are supplied with fuel via a common feed, the fuel being maintained under pressure by means of a common high-pressure pump. For this purpose the fuel can be supplied to the high-pressure pump from a tank by means of a fuel delivery pump. A pressure control valve or a flow control valve is typically disposed upstream of the high-pressure pump for the purpose of setting a pressure, referred to here as a rail pressure, in the common feed of the common rail injection system, i.e. between the high-pressure pump and the injection valves.

The amount of fuel injected into a cylinder during a single injection (injection quantity) is controlled via an injection valve (injector) assigned to said cylinder. However, a prerequisite for precise control of the injected fuel quantity is knowledge of the rail pressure in the common rail injection system, that is to say the pressure prevailing in the fuel between the high-pressure pump and the injection valve. For that reason the system typically has a rail pressure sensor in the region of the common feed, referred to as the common rail, between the high-pressure pump and the injectors in order to enable the rail pressure to be determined.

Accordingly, if the pressure sensor is defective, there is no information concerning the rail pressure available to the engine management system, with the result that it becomes impossible to control the injection quantity. Furthermore, a number of different faults can occur which lead to the rail pressure in the common rail system rising to a value that lies above the measurement range of the pressure sensor. This can be the case, for example, if a flow control valve of the pump sticks in an open position. In this case too there is a lack of the pressure information that is necessary for controlling the injection quantity.

SUMMARY

According to various embodiments, a method can be provided by means of which the rail pressure can be determined independently of the pressure sensor and in particular outside of the measurement range of the pressure sensor. In addition, according to further embodiments, it should be possible to determine the rail pressure without additional components. According to yet further embodiments, a method for controlling an injection quantity and a method for controlling the rail pressure, as well as a common rail injection system that is suitable for performing one of said methods can be provided.

According to an embodiment, in a method for determining the rail pressure in a common rail system of an internal combustion engine, at least one measurement variable is established which is a measure for the angular velocity of a crankshaft movement of the internal combustion engine, and the rail pressure is determined from said measurement variable or from a variable derived from the measurement variable.

According to a further embodiment, for the purpose of determining the rail pressure, at least one difference of the measurement variable or of the variable derived from the measurement variable in at least one phase of the crankshaft movement or a working cycle from the measurement variable in the same phase of the crankshaft movement or of a working cycle at a reference rail pressure can be determined. According to a further embodiment, the measurement variable can be determined in a time-dependent manner and/or for a plurality of phases of the crankshaft movement and/or in an overrun phase of the internal combustion engine. According to a further embodiment, for the purpose of determining the rail pressure, the measurement variable or the variable derived from the measurement variable can be assigned to a rail pressure, preferably taking into account an average rotational speed of the crankshaft. According to a further embodiment, the measurement variable or the variable derived from the measurement variable can be assigned to the rail pressure via a table and/or a numeric function and/or an analytical function, preferably additionally as a function of an average rotational speed of the crankshaft. According to a further embodiment, the table and/or the numeric function and/or the analytical function can be predefined during production of the internal combustion engine and/or determined anew at specific points in time during trouble-free running of the internal combustion engine in an overrun phase, preferably by comparison of the measurement variable or the derived variable with the value of the rail pressure measured by a pressure sensor. According to a further embodiment, the measurement variable can be chosen as the tooth time in at least one phase of the crankshaft movement. According to a further embodiment, an amplitude and/or a maximum value and/or a minimum value of a characteristic curve of the tooth time during at least one segment of the crankshaft movement and/or during a pump cycle of a high-pressure pump of the common rail system can be determined for the purpose of determining the rail pressure as a variable derived from the measurement variable, or in that an amplitude and/or a maximum value and/or a minimum value of a characteristic curve of a difference of the tooth time from a tooth time in the same phase of the crankshaft movement at a reference rail pressure during at least one segment of the crankshaft movement and/or during a pump cycle of a high-pressure pump of the common rail system can be determined as the derived variable and the rail pressure is determined therefrom. According to a further embodiment, the alternating torque of a crankshaft during at least one phase of its movement can be determined from the measurement variable as the derived variable for the purpose of determining the rail pressure.

According to another embodiment, in a method for controlling an injection quantity in an internal combustion engine having a common rail injection system, a rail pressure in the common rail injection system can be determined by means of a method as described above and an opening time and/or activation time of at least one injection valve is controlled as a function of the thus determined rail pressure.

According to yet another embodiment, in a method for controlling the rail pressure in a common rail injection system, a rail pressure in the common rail injection system can be determined by means of a method as described above and the rail pressure is controlled as a function of the thus determined actual rail pressure.

According to a further embodiment of the above method, a switching leakage can be generated at at least one injection valve for the purpose of controlling the rail pressure.

According to yet another embodiment, a common rail injection system for an internal combustion enginemay have a device which is configured for determining at least one measurement variable which is a measure for the angular velocity of a crankshaft movement of the internal combustion engine, and a device which is configured for determining the variable of the rail pressure from said measurement variable or from a variable derived from the measurement variable.

According to a further embodiment of the system, the common rail injection system can be configured by programming means for the purpose of performing one of the methods as described above.

BRIEF DESCRIPTION OF THE DRAWINGS

The method for determining the rail pressure will be explained hereinbelow in an exemplary manner with reference to two figures, in which.

DETAILED DESCRIPTION

Figure 1:
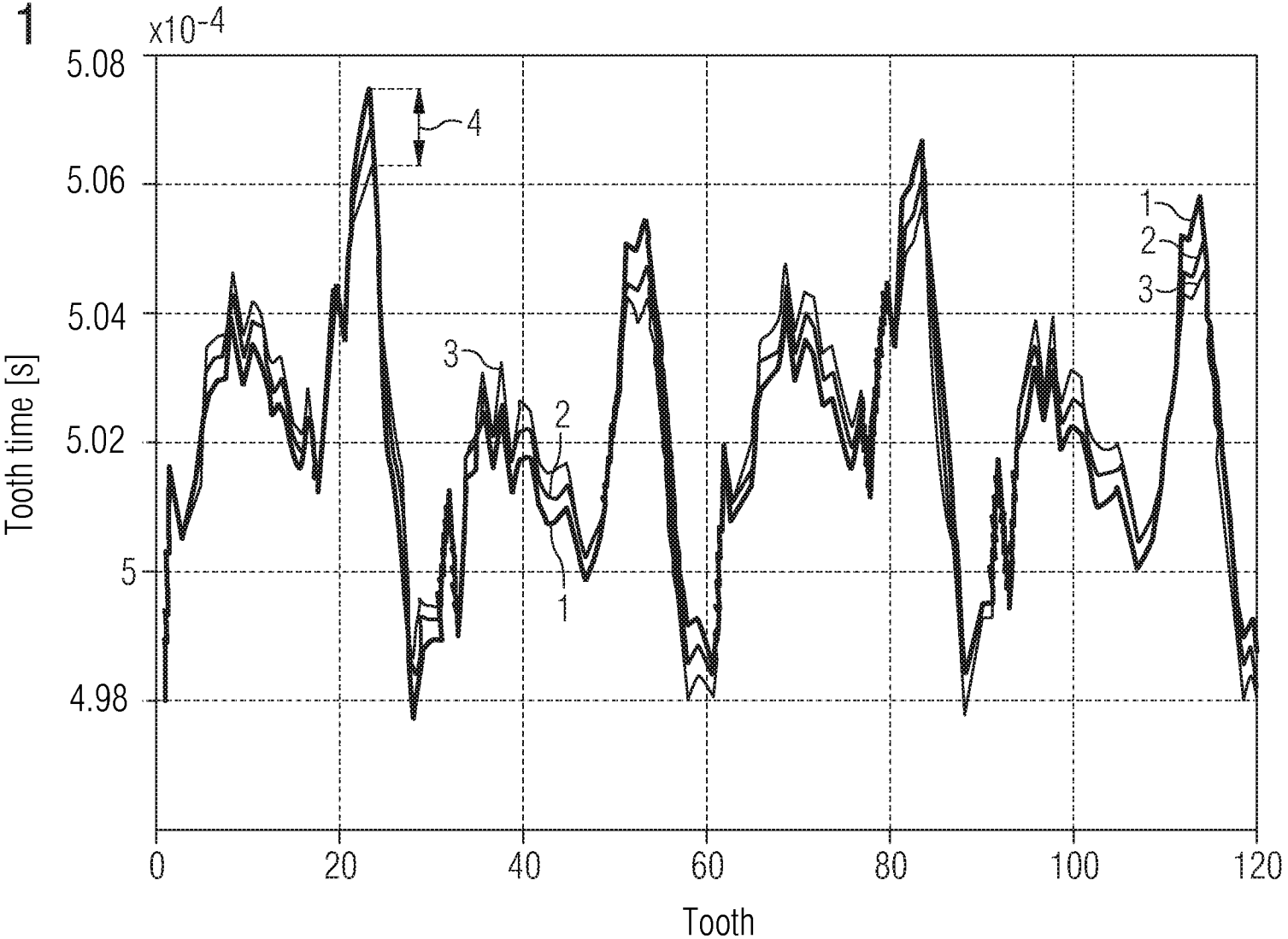
FIG. 1 shows absolute tooth time signals in the course of a period of the engine at different pressures.

In internal combustion engines the high-pressure pump of the common rail injection system is normally driven by the movement of the engine's crankshaft. The various embodiments are thus based on the knowledge that a change in the rail pressure leads to a time-dependent change in the angular velocity of the crankshaft. According to various embodiments, therefore, at least one measurement variable is first established which is a measure for the angular velocity of the crankshaft movement of the internal combustion engine. The rail pressure in the common rail system is then determined from said measurement variable or from a variable derived from said measurement variable. What is to be understood by angular velocity in this context is the angle per time unit through which the crankshaft rotates about its longitudinal axis. This is proportional to the current rotational speed which indicates the number of revolutions of the crankshaft per time unit, the measurement variable in this case being intended to be a temporally highly resolved variable. Rail pressure in this context is to be understood to mean the pressure prevailing in the fuel between the high-pressure pump and the injection valves when all the injection valves are closed.

The proposed method of determining the rail pressure is performed according to various embodiments preferably in an operating state in which no injections take place, in other words when all the injection valves that are supplied by the common rail system are closed, with the exception of a possible switching leakage at the injection valves. Such an operating state is also referred to as an overrun phase. An overrun phase is present in a motor vehicle e.g. when the corresponding internal combustion engine is being moved by the coasting vehicle in a state in which the clutch is engaged, without fuel being injected as a result of the accelerator being pressed.

In an internal combustion engine the angular velocity is normally measured very precisely by way of a so-called tooth time. Toward that end the crankshaft then has a sensor wheel having a plurality of teeth arranged around the circumference of the sensor wheel or similar periodic signal transmitters. When the crankshaft rotates, said teeth or signal transmitters move past a sensor by means of which the passing of a tooth or signal transmitter is registered. Let tooth time in this context refer to the time that elapses between two succeeding teeth or signal transmitters of the sensor wheel passing the sensor or correspondingly between two succeeding comparable edges of a tooth-shaped signal tapped at the sensor. The teeth are typically embodied as magnetic. The sensor can then have a coil and can measure the voltage induced there by the passing teeth. The tooth time is particularly advantageously suitable as a measurement variable for determining the angular velocity, firstly because of its high precision and secondly because this measurement is carried out as standard in any case, so providing additional components for performing the proposed method is unnecessary.

The measurement variable should be resolved sufficiently precisely to yield a plurality of sampling points during each cycle of the engine and during each phase of the movement of the high-pressure pump. If the measurement variable is the tooth time, this precision is achieved by means of a sufficiently large number of teeth on the sensor wheel. Preferably the number of teeth is greater than or equal to 60.

In particular an amplitude of the tooth time or any other measurement variable serving as a measure for the angular velocity of the crankshaft can be used as a variable derived from the measurement variable for the purpose of determining the rail pressure. The reason for this is that the measurement variable typically has an essentially periodic characteristic curve, the amplitude of said characteristic curve being a measure for an alternating torque acting at the crankshaft—caused primarily as a result of compression and decompression in the cylinders. In addition to the tooth time itself, therefore, in particular the alternating torque of the crankshaft or a variable reflecting said alternating torque during at least one segment, preferably in the course of at least one complete working cycle, can therefore be used for determining the rail pressure. Let a segment in this case refer to a crankshaft rotation through an angle of $2\pi$, typically assignable to a combustion stroke of a cylinder, divided by the number of cylinders.

Due to various influences the angular velocity varies in the course of the crankshaft revolution and the strokes of the internal combustion engine. In order to filter out the effect of the rail pressure from said plurality of influences it is preferred if, for the purpose of determining the rail pressure, the difference of the measurement variable in at least one phase of the crankshaft revolution or of the engine operation from a value of said measurement variable is determined during a corresponding phase of the crankshaft revolution or of the engine operation when a reference rail pressure is present. The average rotational speed of the engine during the measurement at the reference pressure should be the same as during the performance of the method according to various embodiments. The average rotational speed is in this case the rotational speed of the engine averaged over a plurality of revolutions of the crankshaft and is proportional to the angular velocity averaged over the corresponding number of revolutions. Influences on the measurement variable that stem from causes other than the rail pressure and that consequently are also present in the reference rail pressure are hereby subtracted from the signal. Accordingly, if the measurement variable is the tooth time, as described as preferred above, the tooth time is measured here and from said measured tooth time is deducted the tooth time determined at a rail pressure having a reference value for the same phase of the crankshaft revolution or engine operation at a same average rotational speed. In this way the effect of the rail pressure can be registered particularly clearly and the rail pressure determined particularly precisely.

In other words, therefore, the rail pressure is preferably determined in that the measurement variable and/or the variable derived therefrom are/is determined both for a current operating state and for a comparative operating state, the comparative operating state being characterized by a reference rail pressure and a rotational speed corresponding to the current operating state. The rail pressure is then yielded as a function of a disparity between the current measurement variable or the variable derived therefrom for the comparative operating state. In this case the measurement variable or the variable derived therefrom for the comparative operating state may possibly also be determined, not by measurement in the comparative state itself, but by corresponding measurements in other operating states and by interpolation.

A movement of the high-pressure pump, sometimes referred to hereinbelow simply as the pump, which is driven directly or indirectly by the crankshaft can be synchronized with the crankshaft movement in a manner that is arbitrary within very wide bounds. The pump or, as the case may be, a drive of the pump can be configured for example in such a way that the pump discharges precisely at the top dead center of a cylinder. In this case the influence of the high-pressure pump significantly changes the maximum, the minimum and the amplitude of the angular velocity of the crankshaft movement itself, such that these parameters can be used directly for determining the rail pressure. For example, if the high-pressure pump is a two-piston pump coupled with a 1:1 transmission to the crankshaft, the pump discharges twice during one revolution of the crankshaft. During said discharge operation there is a slowing down in the angular velocity of the crankshaft, with the result that the tooth time is increased.

In order to be able to determine the aforementioned differences of the measurement variable or the variable derived therefrom from their value at a reference rail pressure it is important to know the characteristic curve of the measurement variable or the variable derived therefrom at the reference rail pressure. Said characteristic curve of the measurement variable over time or of the phase at the reference rail pressure can be specified during the production of the internal combustion engine, preferably for different average rotational speeds, and stored, although it is also possible to determine the reference characteristic curve of the measurement variable anew at specific point in time during the operation of the engine. The measurement variable can be determined in this way e.g. at the time the engine is commissioned, when the engine is switched on, or at specific time intervals. Thus, for example, the measurement variable can be recorded on an hourly basis or every minute in a time-dependent manner or for specific phases of the crankshaft movement for different operating states of the engine, preferably overrun phase operating states, that are typically characterized by an average rotational speed and a boost pressure. The more frequently the measurement variable is recorded, the lower can be kept influences that are not due to the rail pressure. With longer intervals between measurements of the reference values, conversely, longer-term changes in the rail pressure can be detected.

As described, the movement of the high-pressure pump against the rail pressure of the rotational movement of the crankshaft is overlaid by a periodic movement which varies with the period of the pump movement. Amplitude, maximum value and/or minimum value of the measurement variable and/or of the derived variable can be determined particularly easily from the measurement variable recorded in a time-dependent manner or from a variable derived therefrom. The amplitude, maximum value and/or minimum value of the measurement variable can also be the derived variable itself.

If, for example, the discharge phases of the pump coincide with top dead centers of cylinders of the internal combustion engine lying at the start of a combustion stroke of the respective cylinder, the amplitude, maximum value and/or minimum value of the absolute measurement variable can be determined and theoretically used directly as a measure for the rail pressure. On account of the higher precision it is, however, preferred if use is made of the differences obtained as described above from the measurement variable in a reference operating state at a defined reference pressure. In that case the amplitude and/or the maximum value and/or the minimum value of the characteristic curve of the cited difference of the measurement variable during a period of the crankshaft movement or the engine movement or the pump cycle from the corresponding characteristic curve at the reference rail pressure and at the same average rotational speed as well as preferably the same boost pressure can be used for determining the rail pressure, and moreover independently of how the high-pressure pump is constructed and synchronized with the crankshaft. It should however be noted that the differences are in each case formed in phases of working cycles in the mutually compared operating states which correspond to one another both in terms of the crankshaft angle and the strokes of the cylinders and in terms of a phase of the high-pressure pump defined by a tappet position, for example. Toward that end the difference should in each case be monitored over a time period that corresponds to a common cycle of internal combustion engine and high-pressure pump—i.e. at least to a smallest common multiple of two crankshaft revolutions and a crankshaft angle corresponding to a pump cycle.

The actual assignment of a measured value of the measurement variable or of a value of a variable derived from the measurement variable to a rail pressure is possible in a variety of ways. In the simplest case a table that assigns specific rail pressures to specific values of the measurement variable or of the variable derived therefrom for the given average rotational speed can be stored. In order to increase the precision it is also possible to interpolate between the values of the table. The interpolation can take place between different values of the measurement variable as well as between different average rotational speeds. In addition, however, it is also possible to specify the assignment as an analytical or numeric function with the aid of which the rail pressure is calculated from a measured measurement variable or the variable derived therefrom.

The assignment of measurement variables or derived variables to rail pressures can be stored on a one-time basis during production of the engine, though it is also possible to renew the assignment at regular intervals by, for example, measuring the measurement variable and preferably also the average rotational speed and at the same time measuring the pressure associated with the measurement variable or the variable derived therefrom by means of the intact pressure sensor for determining the rail pressure. In the case of a table, therefore, the latter is stored anew at regular intervals. In the case of an analytical function the latter can have parameters which are adjusted with the aid of the thus determined measured values.

It should be noted that a fault in the common rail injection system can lead to a strong increase in the rail pressure, with the result that the latter considerably exceeds the measurement range of the pressure sensor. For this eventuality it is advantageous to specify the assignment of the measurement variables to rail pressures externally, for example during the production of the engine or in the course of an inspection. Alternatively, however, it is also possible to extrapolate from an assignment measured by means of the pressure sensor. A combination of different instances of these assignments is also possible. Thus, for example, the values in the measurement range of the pressure sensor can be regularly updated, while the values lying beyond the measurement range of the pressure sensor are specified externally and remain unchanged.

Alternatively hereto or in combination herewith it is possible, in order to determine the rail pressure, for a difference of the measurement variable from a reference variable to be determined in at least one phase of the crankshaft movement, or for a difference of a variable derived from the measurement variable from a reference variable to be determined in at least one phase of the crankshaft movement. The differences are in turn preferably determined at the same rotational speed and at the same boost pressure. In this case the reference variable can be the measurement variable or the variable derived from the measurement variable in the corresponding phase at an earlier point in time. Alternatively the reference variable can be a value predefined for the corresponding phase.

In order to obtain the most precise results possible for the rail pressure it is preferred if the measurement variable is determined over a plurality of periods of the crankshaft movement, the pump movement or the engine movement and if the measured value is averaged over said plurality of periods. Thus, for example, the maximum, the minimum and/or the amplitude of a plurality of periods can be averaged. In this case the number of periods over which the average is taken can vary and be dependent on how fast the crankshaft rotates. A limit on the number of periods can be imposed for example by opening the injection valves during the operation of the engine, in other words by terminating an overrun phase used for the measurement.

Also proposed with various embodiments is a method for controlling the rail pressure in a common rail injection system, wherein, as described above, the rail pressure is determined and then, based on the thus determined rail pressure, the rail pressure is changed. In this case the change is preferably effected in such a way that the rail pressure is aligned with a setpoint value or in any case is moved into a range in which an injection is possible. Preferably the rail pressure can also be lowered in this way down to a range in which it can be measured by means of the pressure sensor.

A number of possibilities present themselves as suitable for changing the rail pressure. By way of example a defined switching leakage can be generated at at least one injection valve in order to relieve the pressure before the injection valve is opened. In particular the pressure can also be reduced via switching leakages at those injection valves which do not inject during the current stroke of the engine, so that fuel can be injected in the normal way via the other injection valves. An alignment of the rail pressure to a setpoint value can be effected by means of a closed-loop control circuit in that the measurement variable or the variable derived therefrom is brought to a setpoint value that is valid therefor.

According to other embodiments, finally, in a method for controlling the injection quantity in an internal combustion engine having a common rail injection system, the rail pressure is determined as described above and then the opening—in other words an activation time or opening time dependent on a respective target injection quantity—of the injection valves is controlled based on the thus determined rail pressure. The method for controlling the injection quantity can also be used in combination with the method for controlling the rail pressure.

FIG. 1 shows the tooth time in seconds times $10^{-4}$ during the course of an engine period of an internal combustion engine in an overrun phase at three different rail pressures within a common rail injection system of the internal combustion engine, wherein a boost pressure and an average rotational speed have the same values in all three illustrated operating states. In the four-stroke cycle engine used here the characteristic curve along the x-axis therefore comprises four strokes. FIG. 1 shows the absolute tooth time, i.e. the time that elapses between two adjacent teeth of a sensor wheel connected to a crankshaft of the internal combustion engine passing a sensor. In this example the sensor wheel has 60 teeth. This means that during the four strokes of a working cycle the sensor is passed by 120 teeth. The curve identified by 1 now shows the characteristic curve of the tooth time at a rail pressure 160 MPa, curve 2 the characteristic curve of the tooth time at a rail pressure of 100 MPa, and curve 3 the characteristic curve of the tooth time at a rail pressure of 20 MPa. In the example shown, a two-piston high-pressure pump having a transmission ratio of 1:1 is coupled to the crankshaft such that the pump discharges twice during one revolution of the crankshaft and therefore discharges four times during one engine cycle. In the present exemplary embodiment discharge phases of the high-pressure pump therein coincide in each case with a top dead center at the start of a combustion stroke of one of the cylinders.

The influence of the rail pressure can be clearly seen in FIG. 1. For high pressures the tooth time becomes greater in one half of the stroke of a cylinder and less in the other half than in the case of smaller pressures. The lengthening or, as the case may be, shortening of the tooth time is all the greater, the higher is the rail pressure. The rail pressure can therefore be deduced by measuring the increase or decrease in length of the tooth time. Since, however, the absolute value of the tooth time is depicted in the example shown, effects of causes other than the higher rail pressure are also overlaid here. If these are not known at the time of specifying the correlation between measurement variable and rail pressure, they would distort the measurement. The change in the maximum of the tooth time is identified here for the first stroke of the engine by 4.

Figure 2:
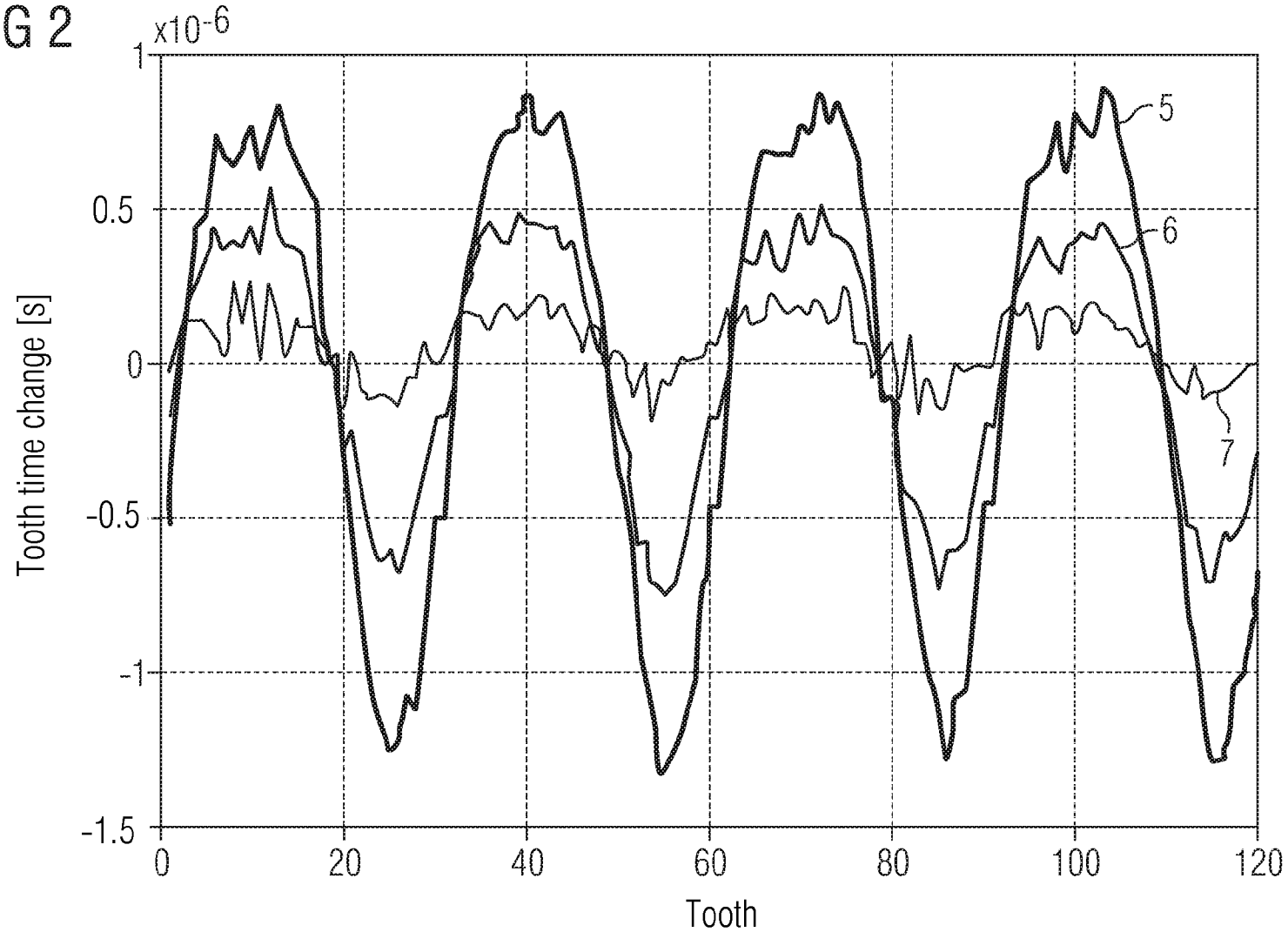
FIG. 2 shows the difference of the tooth time from the tooth time at a reference pressure in the course of an engine period at different pressures.

FIG. 2 shows in seconds times $10^{-6}$ the difference of the tooth time measured during a working cycle from a tooth time in a corresponding phase of the engine cycle at a reference rail pressure and at the same average rotational speed of the crankshaft in comparable operating states. Thus, the difference between the tooth time value measured during the measurement and a tooth time value measured in a reference measurement at a reference rail pressure and in a corresponding phase is determined for each of the passes of a tooth through the sensor. In this case the reference measurement is performed in a reference operating state which in addition to the known reference rail pressure is characterized by values for rotational speed and boost pressure corresponding to the examined operating state. Both the examined (current) operating state for which the rail pressure is to be determined and the reference operating state are overrun phases of the internal combustion engine. In this way all influences on the variation of the tooth time that are not attributable to a change in rail pressure can essentially be eliminated. In particular effects due to the phase of the engine are no longer present in this signal. In the diagram shown the pump discharges four times. The higher the rail pressure against which the pump discharges, the greater is the increase in the length of the tooth time during said discharging process. In FIG. 2, curve 5 was recorded at a rail pressure of 160 MPa, curve 6 at a pressure of 100 MPa, and curve 7 at a pressure of 40 MPa. The tooth time curve recorded at a pressure of 20 MPa at the same rotational speed served as a reference. For the purpose of determining the rail pressure, therefore, the maximum value, the minimum value and/or the amplitude of said tooth time difference can be determined. In this case the determination process is largely independent of other influences than the rail pressure.

In an exemplary embodiment the amplitude of the variation, recognizable in FIG. 2, of the tooth time differences plotted there is used for determining the rail pressure, this being possible owing to the recognizable clear correlation between the two variables. To that end said correlation, which can be determined once for an engine type or repeatedly by means of measurements during operation of an engine, is stored—as a function of rotational speed and boost pressure—in a table or as a numeric or analytical function. Instead of the amplitude the maximum or minimum value of the characteristic curve shown in FIG. 2 can also be used accordingly for determining the rail pressure.

For the purpose of determining the rail pressure as described, the common rail injection system of the internal combustion engine has a device that is correspondingly configured by programming means. Said device can additionally be configured for regulating the thus determined rail pressure and for adjusting an activation time for the injectors assigned to the cylinders of the internal combustion engine as a function of a current target injection quantity which is in turn dependent on a current operating state following the overrun phase used for measuring the rail pressure.

The invention can be used in all engine systems in which fuel is injected via a common rail system. These are primarily engines of motor vehicles, in particular passenger cars or heavy goods vehicles having a spark ignition or diesel engine.

What is claimed is:

1. A method for determining an actual rail pressure existing in a common rail system of an internal combustion engine, comprising:

establishing at least one measurement variable which is a measure for the angular velocity of a crankshaft movement of the internal combustion engine, and determining the actual rail pressure existing in the common rail system from said measurement variable or from a variable derived from the measurement variable.

2. The method according to claim 1, wherein for the purpose of determining the actual rail pressure, at least one difference of the measurement variable or of the variable derived from the measurement variable in at least one phase of the crankshaft movement or a working cycle from the measurement variable in the same phase of the crankshaft movement or of a working cycle at a reference rail pressure is determined.

3. The method according to claim 1, wherein the measurement variable is determined by at least one of: in a time-dependent manner, for a plurality of phases of the crankshaft movement, and in an overrun phase of the internal combustion engine.

4. The method according to claim 1, wherein for the purpose of determining the actual rail pressure, the measurement variable or the variable derived from the measurement variable is assigned to a rail pressure.

5. The method according to claim 1, wherein the measurement variable or the variable derived from the measurement variable is assigned to the rail pressure via at least one of a table, a numeric function, and an analytical function.

6. The method according to claim 1, wherein at least one of the table, the numeric function, and the analytical function are at least one of: predefined during production of the internal combustion engine and determined anew at specific points in time during trouble-free running of the internal combustion engine in an overrun phase.

7. The method according to claim 1, wherein the measurement variable is chosen as a tooth time in at least one phase of the crankshaft movement.

8. The method according to claim 7, wherein at least one of an amplitude, a maximum value, and a minimum value of a characteristic curve of the tooth time during at least one of at least one segment of the crankshaft movement and during a pump cycle of a high-pressure pump of the common rail system are determined for the purpose of determining the actual rail pressure as a variable derived from the measurement variable, or wherein at least one of an amplitude, a maximum value, and a minimum value of a characteristic curve of a difference of the tooth time from a tooth time in the same phase of the crankshaft movement at a reference rail pressure during at least one of at least one segment of the crankshaft movement and during a pump cycle of a high-pressure pump of the common rail system are determined as the derived variable and the rail pressure is determined therefrom.

9. The method according to claim 1, wherein the alternating torque of a crankshaft during at least one phase of its movement is determined from the measurement variable as the derived variable for the purpose of determining the rail pressure.

10. A method for controlling an injection quantity in an internal combustion engine having a common rail injection system, wherein the actual rail pressure in the common rail injection system is determined by means of a method as claimed claim 1, further comprising:

controlling at least one of an opening time and activation time of at least one injection valve as a function of the thus determined actual rail pressure.

11. A method for controlling the rail pressure in a common rail injection system, wherein the actual rail pressure in the common rail injection system is determined by means of a method as claimed in claim 1, further comprising:

controlling the rail pressure as a function of the thus determined actual rail pressure.

12. The method according to claim 1, wherein a switching leakage is generated at least one injection valve for the purpose of controlling the rail pressure.

13. The method according to claim 1, wherein for the purpose of determining the actual rail pressure, the measurement variable or the variable derived from the measurement variable is assigned to a rail pressure taking into account an average rotational speed of the crankshaft.

14. The method according to claim 1, wherein the measurement variable or the variable derived from the measurement variable is assigned to the rail pressure via at least one of a table, a numeric function, and an analytical function additionally as a function of an average rotational speed of the crankshaft.

15. The method according to claim 1, wherein at least one of the table, the numeric function, and the analytical function are at least one of: predefined during production of the internal combustion engine and determined anew at specific points in time during trouble-free running of the internal combustion engine in an overrun phase, by comparison of the measurement variable or the derived variable with the value of the rail pressure measured by a pressure sensor.

16. A common rail injection system for an internal combustion engine, comprising:

a device which is configured for determining at least one measurement variable which is a measure for the angular velocity of a crankshaft movement of the internal combustion engine, and a device which is configured for determining an actual rail pressure existing in the common rail injection system from said measurement variable or from a variable derived from the measurement variable.

17. The common rail injection system according to claim 16, wherein the common rail injection system is configured by programming means operable to:

establish at least one measurement variable which is a measure for the angular velocity of a crankshaft movement of the internal combustion engine, and determine the actual rail pressure from said measurement variable or from a variable derived from the measurement variable.

18. The common rail injection system according to claim 17, wherein the system is further configured for the purpose of determining the actual rail pressure, to determine at least one difference of the measurement variable or of the variable derived from the measurement variable in at least one phase of the crankshaft movement or a working cycle from the measurement variable in the same phase of the crankshaft movement or of a working cycle at a reference rail pressure.

19. The common rail injection system according to claim 17, wherein the system is further configured to determine the measurement variable by at least one of: in a time-dependent manner, for a plurality of phases of the crankshaft movement, and in an overrun phase of the internal combustion engine.

20. The common rail injection system according to claim 17, wherein the system is further configured for the purpose of determining the actual rail pressure, to assign the measurement variable or the variable derived from the measurement variable to a rail pressure.

21. A method for determining the rail pressure in a common rail system of an internal combustion engine, comprising:

establishing at least one measurement variable which is a measure for the angular velocity of a crankshaft movement of the internal combustion engine, determining an alternating torque of a crankshaft during at least one phase of its movement based on the measurement variable, and determining the rail pressure from the determined alternating torque of the crankshaft.

* * * * *